US007789498B2

(12) United States Patent
Sakaida

(10) Patent No.: US 7,789,498 B2
(45) Date of Patent: Sep. 7, 2010

(54) INKJET HEAD

(75) Inventor: Atsuo Sakaida, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 257 days.

(21) Appl. No.: 11/831,330

(22) Filed: Jul. 31, 2007

(65) Prior Publication Data

US 2008/0100676 A1 May 1, 2008

(30) Foreign Application Priority Data

Aug. 7, 2006 (JP) ..... 2006-214892

(51) Int. Cl.
*B41J 2/045* (2006.01)

(52) U.S. Cl. ..... 347/72

(58) Field of Classification Search ..... 347/72, 347/68–71; 400/124.16, 124.17; 310/363–366; 29/25.35

See application file for complete search history.

(56) References Cited

U.S. PATENT DOCUMENTS

| | | | |
|---|---|---|---|
| 6,550,897 | B2 | 4/2003 | Nakamura et al. |
| 6,971,738 | B2 | 12/2005 | Sugahara |
| 7,086,711 | B2 | 8/2006 | Iwao et al. |
| 7,150,518 | B2 | 12/2006 | Watanabe |

FOREIGN PATENT DOCUMENTS

| | | | |
|---|---|---|---|
| JP | 2002-248765 | A | 9/2002 |
| JP | 2004-114362 | A | 4/2004 |
| JP | 2005-059328 | A | 3/2005 |
| JP | 2006-123275 | A | 5/2006 |

OTHER PUBLICATIONS

Japanese Patent Office, Notification of Reasons for Refusal for Japanese Patent Application No. 2006-214892, mailed Sep. 9, 2008.

*Primary Examiner*—K. Feggins
(74) *Attorney, Agent, or Firm*—Baker Botts L.L.P.

(57) ABSTRACT

An inkjet head includes a passage unit having a pressure chamber which is in communication with a nozzle and which is defined by a recessed portion provided in one surface of the passage unit; and an actuator unit including: (a) an oscillating plate fixed to the one surface of the passage unit so as to close the recessed portion defining the pressure chamber; (b) a piezoelectric layer disposed on the oscillating plate so that the piezoelectric layer and the oscillating plate cooperate with each other to constitute a piezoelectric unimorph; (c) a first electrode provided on a side of one surface of the piezoelectric layer so as to correspond to the pressure chamber; and (d) a second electrode provided on a side of an other surface of the piezoelectric layer and opposed to the first electrode in a direction of thickness of the piezoelectric layer. The pressure chamber has an elongate shape. The piezoelectric layer includes an active portion that is interposed between the first electrode and the second electrode and, as seen in the direction of thickness of the piezoelectric layer, is not located in a central portion of an opposed area thereof opposed to the pressure chamber and is located on either side of said central portion of the opposed area in a widthwise direction perpendicular to a lengthwise direction of the pressure chamber, the opposed area of the piezoelectric layer being deformed to increase a volume of the pressure chamber when an electric field is applied to the active portion.

15 Claims, 11 Drawing Sheets

INKJET HEAD

CROSS REFERENCE TO RELATED APPLICATION

The present application claims priority from Japanese Patent Application No. 2006-214892, which was filed on Aug. 7, 2006, the disclosure of which is herein incorporated by reference in its entirety.

BACKGROUND OF THE INVENTION

1. Field of the Invention

The present invention relates to an inkjet head that ejects ink toward a recording medium.

2. Discussion of Related Art

Patent Document 1 (JP-A-2004-114362) discloses an inkjet head including a plurality of pressure chambers in communication with a plurality of nozzles and an actuator unit for changing a volume of each of the pressure chambers. In the inkjet head, the actuator unit includes (1) five piezoelectric sheets that are stacked on each other, (2) a plurality of individual electrodes each of which is opposed to a central portion of each of the pressure chambers, and (3) a plurality of common electrodes each of which is provided over the plurality of pressure chambers.

The plurality of individual electrodes are disposed on an upper surface of a first layer of the five piezoelectric sheets and between a second layer and a third layer of the piezoelectric sheets. The common electrodes are disposed between the first and the second piezoelectric sheets and between the third and a fourth piezoelectric sheets. Respective portions of the first, the second, and the third sheets that are interposed between the individual electrodes and the common electrodes constitute active layers (active portions) that contract in a direction perpendicular to a direction of polarization thereof when an electric field is applied thereto. The fourth and a fifth piezoelectric sheets constitute non-active layers. In the actuator unit, when the electric field is applied to the active layers, a difference in strain in the polarization direction is generated between the first to third piezoelectric sheets and the fourth and fifth piezoelectric sheets, so that each of respective opposed areas of the five piezoelectric sheets that are opposed to the pressure chambers is deformed into a convex shape toward the corresponding pressure chamber, so as to constitute a piezoelectric unimorph. Thus, in the actuator unit, so-called "fill before fire" method can be performed. In the "fill before fire" method, the volume of the pressure chamber is once increased so as to introduce ink into the pressure chamber and then the volume of the pressure chamber is decreased so as to apply an intense pressure to the ink accommodated in the pressure chamber.

More specifically, during a waiting time or when ink is not ejected through the nozzles, the common electrodes are kept at a ground potential and a predetermined electric voltage is kept applied to the individual electrodes. In this state, each opposed area is deformed into the convex shape toward the corresponding pressure chamber, so as to decrease the volume of the pressure chamber. When a printing operation is performed in which ink is ejected through the nozzles, the individual electrodes are returned to a zero potential, whereby the piezoelectric sheets return to their initial or normal positions so that the volume of the pressure chamber returns to its normal or initial state, that is, the volume of the pressure chamber is increased from the volume thereof during the waiting time. Thus, a pressure wave is generated in the pressure chamber. Then, when the predetermined electric voltage is again applied to the individual electrodes at a timing when the pressure wave turns positive, the volume of the pressure chamber is decreased, so that an intense pressure is applied to the ink accommodated in the pressure chamber, while being influenced by the pressure wave generated by returning the piezoelectric sheets to their initial positions and the pressure wave generated by decreasing the volume of the pressure chamber. Therefore, two pressures are added to each other, and a considerably small energy suffices to apply a high pressure to the ink, leading to enjoying a high efficiency of the actuator unit.

However, in the inkjet head disclosed in the Patent Document 1, when the printing operation is not performed or during the waiting time, the electric field is kept applied to the active portions interposed between the individual electrodes and the common electrodes. That is, during the waiting time, each opposed area is kept deformed into the convex shape toward the corresponding pressure chamber for a considerably long time compared to a time period when the printing operation is performed. When the electric field is applied to the piezoelectric sheets for a long time, the piezoelectric sheets deteriorate with respect to polarization so that an amount of deformation of the piezoelectric sheets gradually decreases, leading to lowering a pressure applied to the ink accommodated in the pressure chamber.

SUMMARY OF THE INVENTION

It is therefore an object of the present invention to provide an inkjet head that can restrain the decrease in the amount of deformation of the piezoelectric sheets.

According to the present invention, there is provided an inkjet head, comprising: a passage unit having a pressure chamber which is in communication with a nozzle and which is defined by a recessed portion provided in one surface of the passage unit, and an actuator unit including: (a) an oscillating plate fixed to the one surface of the passage unit so as to close the recessed portion defining the pressure chamber; (b) a piezoelectric layer disposed on the oscillating plate so that the piezoelectric layer and the oscillating plate cooperate with each other to constitute a piezoelectric unimorph; (c) a first electrode provided on a side of one surface of the piezoelectric layer so as to correspond to the pressure chamber; and (d) a second electrode provided on a side of an other surface of the piezoelectric layer and opposed to the first electrode in a direction of thickness of the piezoelectric layer, wherein the pressure chamber has an elongate shape, and wherein the piezoelectric layer includes an active portion that is interposed between the first electrode and the second electrode and, as seen in the direction of thickness of the piezoelectric layer, is not located in a central portion of an opposed area thereof opposed to the pressure chamber and is located on either side of the central portion of the opposed area in a widthwise direction perpendicular to a lengthwise direction of the pressure chamber, the opposed area of the piezoelectric layer being deformed to increase a volume of the pressure chamber when an electric field is applied to the active portion.

It is preferable that the active portion, as seen in the direction of thickness of the piezoelectric layer, does not extend, in the widthwise direction of the pressure chamber, to a range of the opposed area of the piezoelectric layer, the range restricting the deformation of the opposed area to increase the volume of the pressure chamber when the electric field is applied to the active portion.

The oscillating plate having an electric conductivity may also function as the second electrode.

In the present inkjet head, when the electric field is applied to the active portion, the active portion contracts in a direction parallel to a plane thereof and the opposed area opposed to the pressure chamber is deformed into a convex shape in a direction away from the pressure chamber, that is, in a direction away from the oscillating plate. As a result, the volume of the pressure chamber is increased so as to produce a pressure wave. Then, when the electric field applied to the active portion is stopped at a timing when the pressure wave turns positive, the piezoelectric layer is returned to an initial state or a normal state and the volume of the pressure chamber is decreased. An intense pressure is applied to the ink accommodated in the pressure chamber while being influenced by the pressure wave generated by increasing the volume of the pressure chamber and a pressure wave generated by returning the piezoelectric layer to its initial state, so that ink is ejected through the corresponding nozzle. Thus, the electric field is applied only at a timing when ink is ejected, so that the decrease in the volume of deformation of the piezoelectric layer influenced by the deterioration of the piezoelectric layer with respect to the polarization thereof can be restrained.

In the preferred embodiment in which the active portion, as seen in the direction of thickness of the piezoelectric layer, does not extend, in the widthwise direction of the pressure chamber, to the range of the opposed area that restricts the deformation of the opposed area to increase the volume of the pressure chamber when the electric field is applied to the active portion, the pressure applied to the ink accommodated in the pressure chamber is prevented from decreasing, leading to enjoying a high efficiency of the inkjet head.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
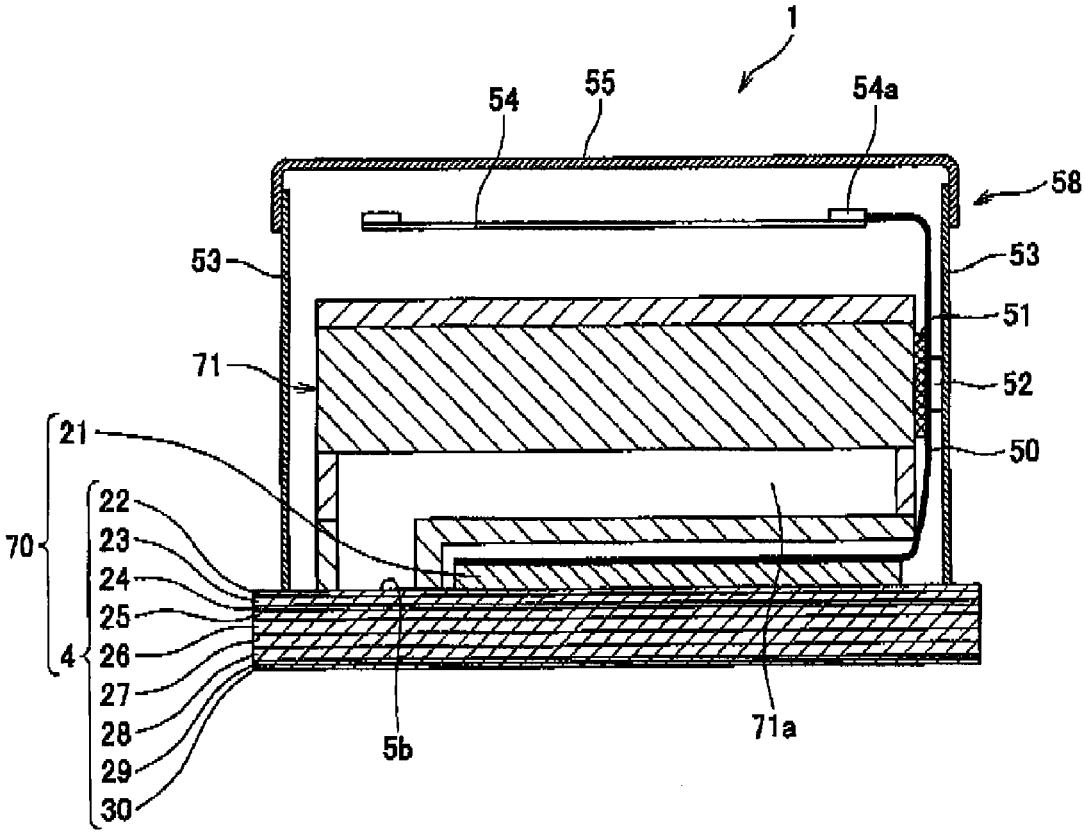
FIG. 1 is a cross-sectional view of an inkjet head as a first embodiment to which the present invention is applied.

Hereinafter, there will be described preferred embodiments of the present invention by reference to the drawings. FIG. 1 shows an inkjet head 1 as a first embodiment according to the present invention. As shown in FIG. 1, the inkjet head 1 includes (a) a head body 70 for ejecting ink, (b) a reservoir unit 71 provided on an upper surface of the head body 70, (c) a flexible printed circuit (FPC) 50 electrically connected to the head body 70, and (d) a controller circuit board 54 electrically connected to the FPC 50. The head body 70 includes a passage unit 4 having ink passages therein and four actuator units 21. The reservoir unit 71 supplies ink to the passage unit 4. A driver IC 52 for supplying a drive signal is mounted on a middle portion of the FPC 50 and one end portion of the FPC 50 is connected to respective upper surfaces of the actuator units 21.

Figure 2:
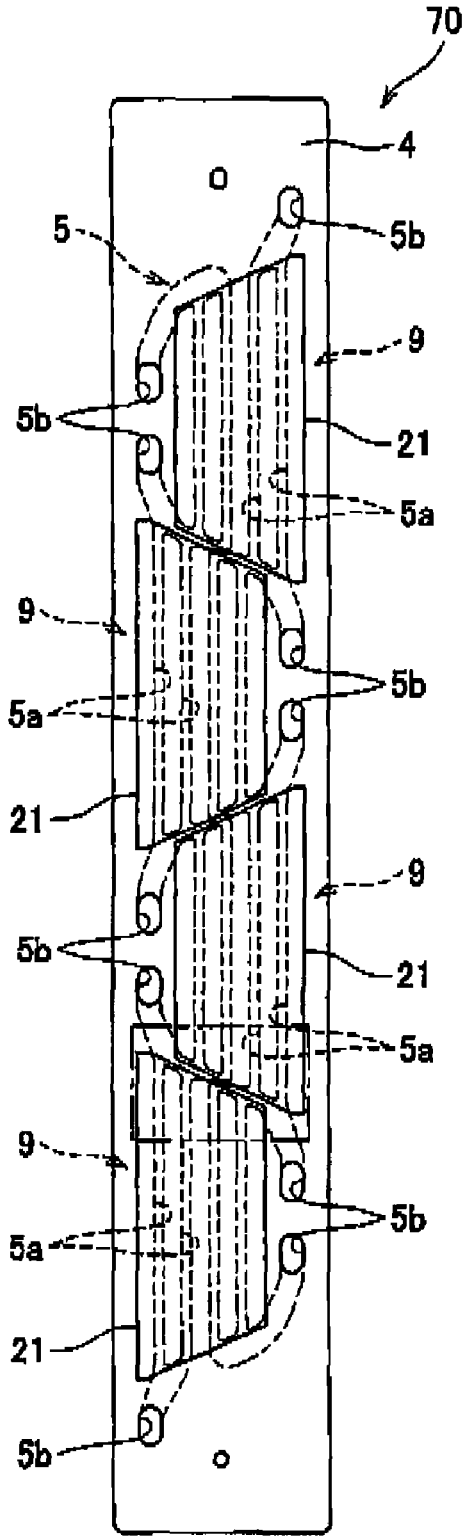
FIG. 2 is a plan view of a recording head of the inkjet head.

The head body 70 has a structure in which the actuator units 21 are provided on an upper surface (one surface) of the passage unit 4. As shown in FIG. 2, ten ink supply openings 5*b* are formed in the upper surface of the passage unit 4, such that the ink supply openings 5*b* are in communication with the ink passages provided in the passage unit 4. The ink passages include a plurality of pressure chambers 10 which are provided in the upper surface of the passage unit 4 and a plurality of ink ejection nozzles 8 which are in communication with the respective pressure chambers 10.

Above the reservoir unit 71, the controller circuit board 54 is provided horizontally and connected to the other end portion of the FPC 50 via a connector 54*a*. Thus, based on a command from the controller circuit board 54, the driver IC 52 supplies drive signals to the actuator units 21 through wires (signal wires) of the FPC 50.

The reservoir unit 71 includes an ink reservoir 71*a* which accommodates ink and is in communication with the ink supply openings 5*b* of the passage unit 4. Therefore, the ink accommodated in the ink reservoir 71*a* is supplied to the ink passages in the passage unit 4 via the ink supply openings 5*b*.

The actuator units 21, the reservoir unit 71, the controller circuit board 54 and the FPC 50 are covered by a cover member 58 consisting of a side cover 53 and a head cover 55 so that ink or ink mist spread outside is prevented from entering into a space covered by the cover member 58. The cover member 58 is formed of a metallic material. Also, an elastic sponge 51 is provided on one side surface of the reservoir unit 71. As shown in FIG. 1, the driver IC 52 mounted on the FPC 50 is opposite to the sponge 51 and is pressed against an inner surface of the side cover 53 by the sponge 51. Therefore, heat generated by the driver IC 52 is transmitted to the head cover 55 through the side cover 53 and quickly radiated outward through the metallic cover member 58. Thus, the cover member 58 also functions as a heat radiating member or device.

Figure 3:
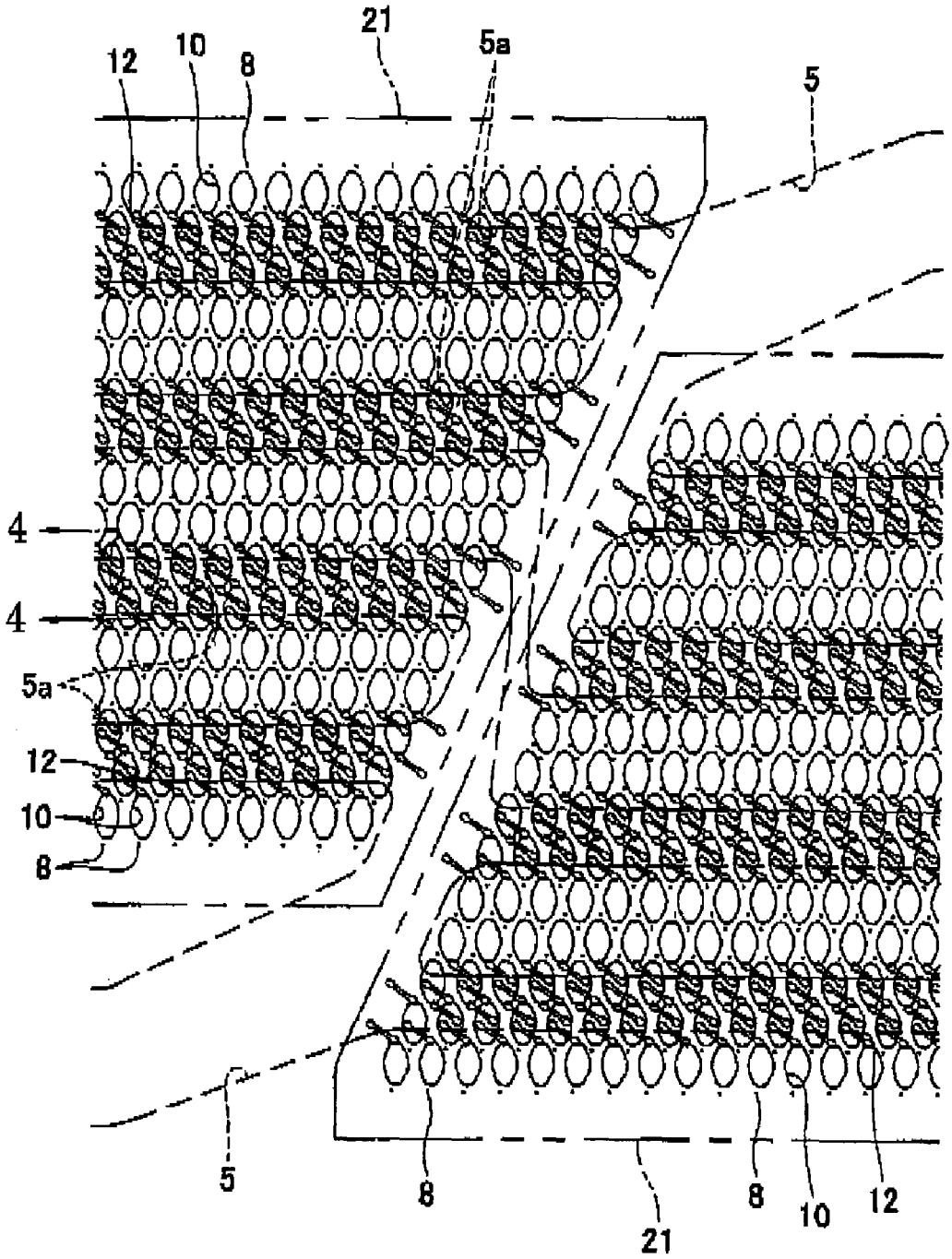
FIG. 3 is an enlarged plan view of an area of the recording head enclosed with a one-dot chain line in FIG. 2.

There next will be described the head body 70 in detail. As shown in FIGS. 2 and 3, the passage unit 4 of the head body 70 includes a multiplicity of the pressure chambers 10 and a multiplicity of the nozzles 8 which are in communication with the respective pressure chambers 10. In the upper surface of the passage unit 4, the multiplicity of pressure chambers 10 are arranged in two directions which intersect each other and one of which is a vertical direction in FIG. 2 as a lengthwise direction of the passage unit 4, such that the pressure chambers 10 are arranged like a matrix. As shown in FIG. 3, a plurality (four) of pressure chamber groups 9 are constituted by the pressure chambers 10. Further, corresponding to the arrangement of the four pressure chamber groups 9, the four actuator units 21 are respectively adhered to the passage unit 4 in two rows, in a zigzag or a staggered manner. As shown in FIG. 2, the pressure chamber groups 9 and the actuator units 21 have trapezoidal shapes in their plan view.

A plurality of areas in a lower surface of the passage unit 4 that correspond to the areas to which the actuator units 21 are respectively adhered constitute trapezoidal ink-ejection areas each of which has the multiplicity of the nozzles 8. The nozzles 8 are, similar to the pressure chambers 10, arranged like a matrix and in a plurality of nozzle rows extending in the lengthwise direction of the passage unit 4. As mentioned above, since the actuator units 21 are arranged in two rows, in a zigzag or a staggered manner, the plurality of nozzle rows (hereinafter, each of which will be referred to as "a partial nozzle row" for a convenience of explanation) corresponding to the actuator units 21 adjacent to each other have a gap therebetween in the widthwise direction. However, four partial nozzle rows, each of which is selected out of the partial nozzle rows corresponding to each of the four actuator units 21, are relatively positioned so as to cooperate with each other to form one nozzle row without a gap (hereinafter, referred to as "an entire nozzle row", as compared with the partial nozzle row) as seen in the widthwise direction of the passage unit 4. Since respective applying timings at which a drive voltage is applied to the adjacent two of the four partial nozzle rows are shifted corresponding to the gap in the widthwise direction between the two partial nozzle rows adjacent to each other, a printing operation is performed through the four partial nozzle rows as if the four partial nozzle rows are in a row as the entire nozzle row.

In the present embodiment, as shown in FIG. 3, sixteen rows of the pressure chambers 10, which are arranged at a regular distance in the lengthwise direction of the passage unit 4, are arranged parallel to each other in the widthwise direction of the passage unit 4. Corresponding to the trapezoidal shape of each actuator unit 21, respective numbers of the pressure chambers 10 of the sixteen pressure-chamber rows gradually decrease in a direction from a long side of the trapezoidal shape toward a short side thereof. Also, the nozzles 8 are arranged in the same manner as the manner in which the pressure chambers 10 are arranged. Thus, an image recording operation can be performed at a resolution of 600 dpi. Each pressure chamber 10 has, in its plan view, a substantially rhombic elongate shape (a parallelogramic shape with rounded corners) which has two acute-angled end portions in opposite end portions of the pressure chamber 10 in a lengthwise direction of the pressure chamber 10 and two obtuse-angled end portions in a middle portion thereof in the lengthwise direction thereof or in opposite end portions thereof in a widthwise direction thereof perpendicular to the lengthwise direction.

As shown in FIGS. 2 and 3, in the passage unit 4, there are provided a plurality of trunk manifold channels 5 which are in communication with the ink supply openings 5*b* and a plurality of branch manifold channels 5*a* which are branched from the trunk manifold channels 5. Each trunk manifold channel 5 has a portion extending along an oblique side or sides of one or two actuator units 21. One trunk manifold channel 5 is provided in an area interposed between each pair of actuator units 21 adjacent to each other and is common to the adjacent two actuator units 21, and the branch manifold channels 5*a* are branched from opposite side portions of the trunk manifold channel 5. The branch manifold channels 5*a* extend in the lengthwise direction of the passage unit 4.

As shown in FIG. 3, the multiplicity of nozzles 8 are arranged in the lengthwise direction of the passage unit 4. Each nozzle 8 is in communication with the corresponding branch manifold channel 5*a* via an aperture 12 as a restrictor channel. As shown in FIG. 3, for the sake of easy understanding, the actuator units 21 are illustrated in two-dot chain lines and the pressure chambers 10 and the apertures 12 are illustrated in solid lines though the pressure chambers 10 and the apertures 12 are located below the actuator units 21 and should be illustrated in broken lines.

Figure 4:
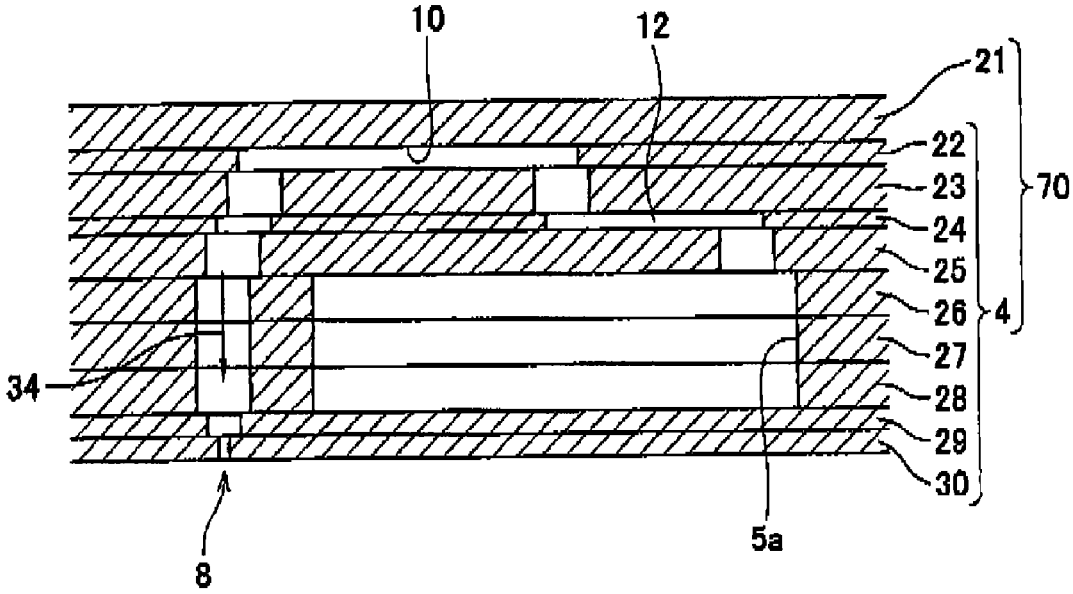
FIG. 4 is a cross-sectional view taken along line 4-4 in FIG. 3.

Next, a cross-sectional structure of the head body 70 will be described. As shown in FIG. 4, the head body 70 includes the passage unit 4 and the actuator units 21 that are stacked on, and adhered to, each other. The passage unit 4 has a laminar structure including nine metallic plates that are stacked on each other. The stacked nine plates includes, from an upper side thereof, a cavity plate 22, a base plate 23, an aperture plate 24, a supply plate 25, manifold plates 26, 27, 28, a cover plate 29 and a nozzle plate 30. Holes which are respectively formed in the nine metallic plates 22 through 30 define an individual ink passage 34 extending in the passage unit 4 from an outlet of the branch manifold channel 5*a* to each nozzle 8 through the aperture 12 and the pressure chamber 10. As shown in FIG. 4, the hole that is formed in the cavity plate 22 and defines the pressure chamber 10 is partly closed by the base plate 23, so that a recessed portion defining the pressure chamber 10 is formed and an opening of the recessed portion defining the pressure chamber 10 opens in the upper surface of the passage unit 4. The actuator units 21 are adhered to the upper surface of the passage unit 4 so as to close the openings of the recessed portions defining the pressure chambers 10.

Figure 5A:
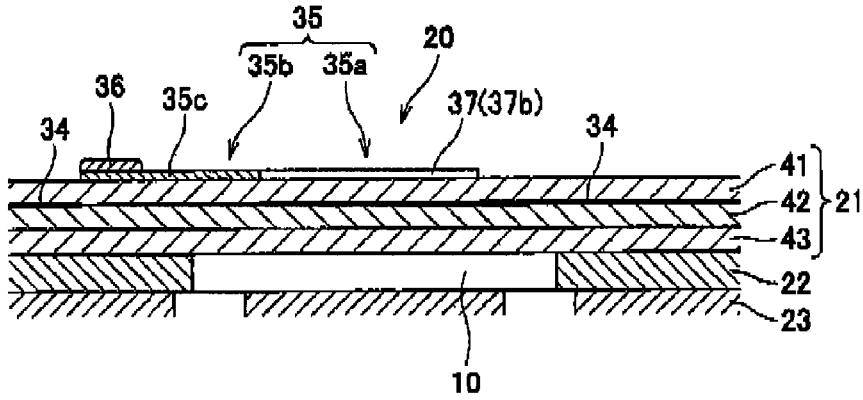
FIG. 5A is a cross-sectional view of an actuator unit of the inkjet head.
Figure 5B:
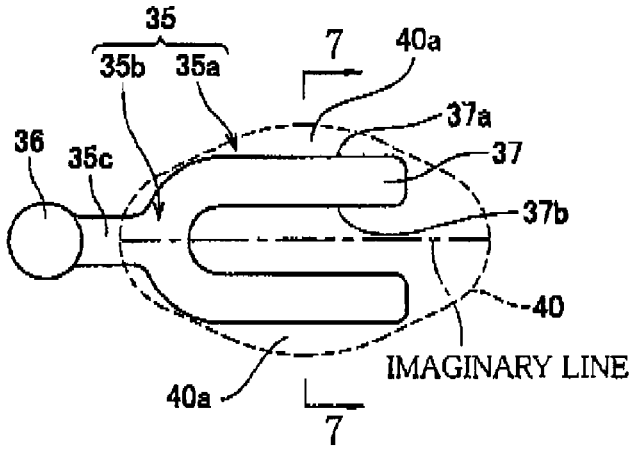
FIG. 5B is a plan view of an individual electrode of the actuator unit.

Next, there will be described each actuator unit 21. As shown in FIGS. 5A and 5B, the actuator unit 21 includes three piezoelectric layers or sheets 41, 42, 43 which are staked on each other, a plurality of individual electrodes 35 as first electrodes provided on an upper surface (one surface) of the uppermost piezoelectric sheet 41, and a common electrode 34 as a second electrode which is interposed between the piezoelectric sheets 41, 42, i.e., is provided on a lower surface (an other surface) of the piezoelectric sheet 41.

The piezoelectric sheets 41, 42, 43 are formed of a lead (Pb)-zirconate-titanate (PZT)-based ceramic material having ferroelectricity and are located over all the pressure chambers 10 which belongs to one pressure chamber group 9 (shown in FIG. 2) provided in one ink ejection area of the head body 70. Each of the three piezoelectric sheets 41, 42, 43 consists of one sheet which is common to the plurality of pressure chambers 10 and which has a uniform thickness over an entirety thereof. The two piezoelectric sheets 42, 43 out of the three piezoelectric sheets 41, 42, 43 have no active portions K (shown in FIG. 7) which will be described later, and function as oscillating plates. In the actuator unit 21, the piezoelectric sheet 41 including the active portions K are disposed on the piezoelectric sheets 42, 43 (the oscillating plates) so that the piezoelectric sheet 41 and the piezoelectric sheets 42, 43 cooperate with each other to constitute a piezoelectric unimorph.

In a modified embodiment of the present invention, the piezoelectric sheet 43 may be changed to a flat plate (an oscillating plate) formed of a metal. In this modified embodiment, the piezoelectric sheet 42 functions as an insulating layer so that the common electrode 34 and the oscillating plate are not electrically connected to each other. The oscillating plate 43 formed of a metallic flat plate increases a rigidity of the actuator unit 21. Further, the common electrode 34 and the piezoelectric sheet 43 may be omitted and the piezoelectric sheet 42 may be a flat plate formed of an electrically conductive material. In this case, the flat plate can function as an oscillating plate and a common electrode. Also, the flat plate may be made of a metal so as to increase a rigidity of the actuator unit 21.

Each of the plurality of the individual electrodes 35 and the common electrode 34 are made of a metallic material such as a Ag—Pd based metallic material. The individual electrodes 35 correspond to the respective pressure chambers 10. In FIG. 5B, an area corresponding to the opening of the pressure chamber 10 provided in the upper surface of the cavity plate 22 is shown in a broken line as a pressure chamber area 40 of the piezoelectric sheet 41 of the actuator unit 21.

Each individual electrode 35 includes a main electrode area 35*a* which is opposed to the opening of the pressure chamber 10 and extends in a lengthwise direction of the pressure chamber area 40 and a connection area 35*b* which is opposed to a vicinity of one of the two acute-angled end portions of the pressure chamber area 40 (a left-hand one in FIG. 5B) and is connected to the main electrode area 35*a*. Each individual electrode 35 is a U-shaped, belt-like electrode which is not located in a central portion of the pressure chamber area 40 as an opposed area which is opposed to the pressure chamber 10 and is located on either side of the central portion of the pressure chamber area 40. A center of the connection area 35*b* is aligned with the pressure chamber 10 as seen in the direction of thickness of the piezoelectric sheet 41, so that the plurality of pressure chambers 10 can be arranged at a high density.

As shown in FIG. 5B, the main electrode area 35*a* includes a pair of electrode portions 37 which extend along respective two sides of the opening of the pressure chamber 10 that extend in the lengthwise direction of the pressure chamber 10 and are opposed to each other. A substantial entirety of the pair of electrode portions 37 is located within an area defined by the two sides of the opening of the pressure chamber 10, as seen in the direction of thickness of the piezoelectric sheet 41. Each of the electrode portions 37 is defined, as seen in the direction of thickness of the piezoelectric sheet 41, by an outer periphery 37*a* which extends substantially parallel to the lengthwise direction of the pressure chamber area 40 and an inner periphery 37*b*. The inner peripheries 37 of the pair of electrode portions 37 extend parallel to an imaginary line connecting the two acute-angled portions of the pressure chamber area 40 and extending in the lengthwise direction of the same 40 through a center thereof and are distant from the imaginary line by a same distance. The pair of electrode portions 37 are provided symmetrically with respect to the imaginary line as a centerline. The pair of electrode portions 37, on the middle portion of the pressure chamber 10 in the lengthwise direction, have a clearance 40*a* between a periphery of the opening of the pressure chamber 10 at each of the obtuse-angled portions thereof and the outer periphery 37*a* of each electrode portion 37, as seen in the direction of thickness of the piezoelectric sheet 41.

The connection area 35*b* has an extending portion 35*c* which extends from one of the acute-angled end portions of the pressure chamber area 40 in a direction opposite to the other of the two acute-angled end portions thereof, i.e., outward from the pressure chamber area 40. The extending portion 35*c* is connected to an electrode land 36 which is provided outside an area of the pressure chamber 10 (the pressure chamber area 40). For example, the electrode land 36 is formed of a gold including a glass frit. The land 36 is connected to an electric wire provided in the FPC 50. That is, the plurality of individual electrodes 35 are electrically connected individually to the driver IC 52 via the electrode lands 36 and the electric wires, so that a drive signal (a drive voltage) is transmitted from the driver IC 52 selectively to each of the individual electrodes 35.

As shown in FIG. 5A, the common electrode 34 is provided over an entirety of an area interposed between the piezoelectric sheets 41, 42 except for the areas opposed to the electrode lands 36, the extending portions 35*c* and the connection areas 35*b*. That is, the common electrode 34 is opposed to an entirety of each main electrode area 35*a* and is not opposed to each connection area 35*b* in the direction of thickness of the piezoelectric sheet 41. Therefore, a portion of the uppermost piezoelectric sheet 41 which corresponds to each pressure chamber area 40 and is interposed between each main electrode area 35*a* and the common electrode 34 constitutes the active portion K (shown in FIG. 7) which contracts in a direction perpendicular to a polarization direction when the main electrode area 35*a* is given a potential different from that of the common electrode 34.

Since the electrode land 36, the extending portion 35*c* and the connection area 35*a* are not opposed to the common electrode 34, the corresponding portion of the piezoelectric sheet 41 that are opposed to the electrode land 36, the extending portion 35*c* and the connection area 35*a* is not deformed by a potential difference, so that crosstalks do not occur to another pressure chamber 10 adjacent to the pressure chamber 10 opposed to the corresponding portion of the piezoelectric sheet 41. Also, the corresponding portion of the piezoelectric sheet 41 does not contribute to the ejection of ink.

In the present embodiment, in the stacked body consisting of the three piezoelectric sheets 41 through 43, actuator unit structures 20 shown in FIG. 5A are provided corresponding to the pressure chambers 10 and constitute one actuator unit 21. As mentioned below, the one actuator unit 21 corresponds to one pressure chamber group 9.

In the upper surface of the uppermost piezoelectric sheet 41, a surface electrode (not shown) is provided along with the plurality of individual electrodes 35 and is electrically connected to the common electrode 34 via a through-hole formed through the piezoelectric sheet 41. Similar to the individual electrodes 35, the surface electrode is connected to an electric wire in the FPC 50 and is kept at a predetermined reference potential (for example, a ground potential) by the driver IC 52.

Figure 6:
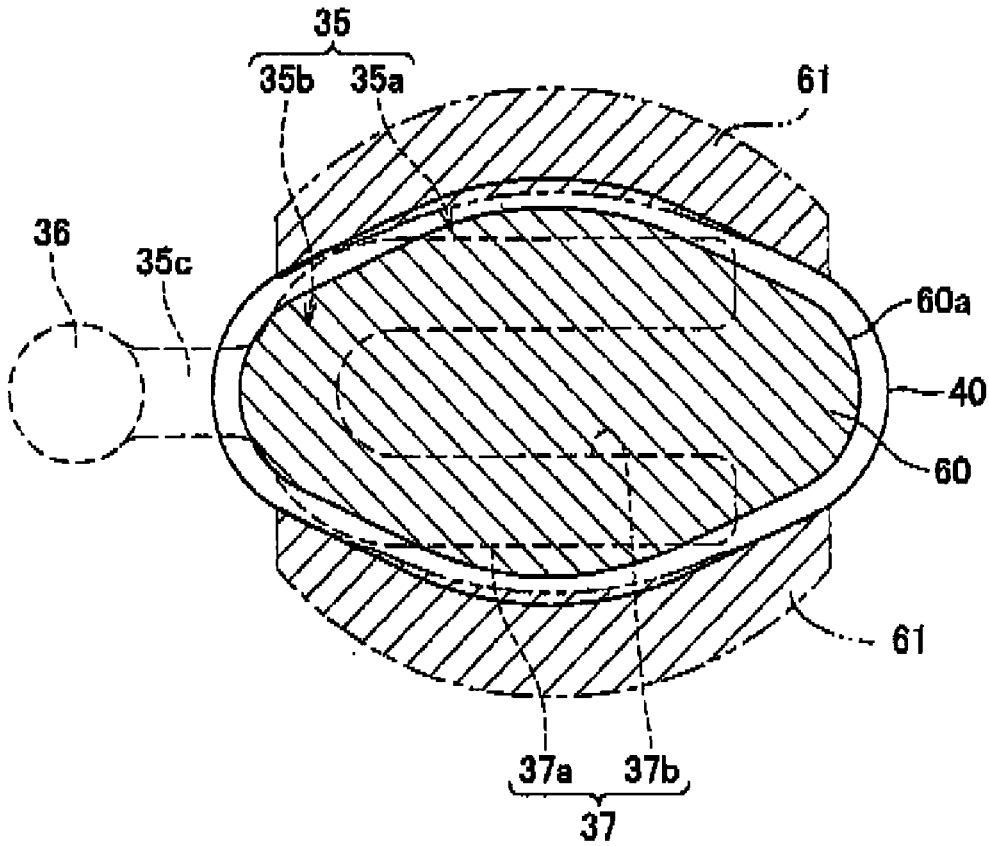
FIG. 6 is a plan view of the actuator unit showing distinguished areas of a piezoelectric layer influencing a change in a volume of a pressure chamber of the actuator unit by a way and an extent of influence with respect to an ink ejection.

There next will be described areas which influence a change in the volume of each pressure chamber 10. In FIG. 6, the pressure chamber area 40 of the actuator unit 21 is illustrated in a solid line. A base line 60*a* is illustrated at a specific position in the pressure chamber area 40. The base line 60*a* indicates a position in the pressure chamber area 40 which does not contribute to a change in the volume of the pressure chamber 10 in a case in which an electrode (a small individual electrode) is provided on the base line 60*a* and a drive voltage is applied to the electrode. In other words, even if the electrode is provided on the base line 60*a* and an active portion is present on the base line 60*a*, the electrode has no function to change the volume of the pressure chamber 10 so as to eject ink. The base line 60*a* encloses a rhombic area similar to the pressure chamber area 40. The area enclosed by the base line 60*a* indicates a function area 60 which functions to change the volume of the pressure chamber 10 and eject ink in a case in which an electrode (a small individual electrode) is provided on the enclosed area and a drive voltage is applied to the electrode.

On the other hand, an area outside the base line 60*a* functions to restrict an activity of an electrode provided in an area inside the base line 60*a* in a case in which an electrode is provided in the outside area and a drive voltage is applied to the latter electrode. However, as shown in FIG. 6, a portion of the area outside the base line 60*a* that is located in the vicinity of the base line 60*a* and excludes portions in the vicinity of the obtuse-angled portions of the pressure chamber area 40, that is, areas between the base line 60*a* and two restricting areas 61 described later, does not substantially function to restrict the ejection of ink. Also, areas outside the base line 60*a* that are located in the vicinity of the acute-angled end portions of the pressure chamber area 40 do not substantially function to restrict the ink ejection.

In the present embodiment, as shown in FIG. 6, the restricting areas 61, which function to substantially restrict a desired ink ejection, extend from the vicinities of the two obtuse-angled portions of the pressure chamber area 40 to the vicinities of the two acute-angled end portions thereof along an outer periphery of the pressure chamber area 40. Portions of the restricting areas 61 in the vicinity of the two obtuse-angled portions extend inward to the pressure chamber area 40.

In FIG. 6, the individual electrode 35 and the electrode land 36 are respectively illustrated in broken lines and a most part of the main electrode area 35*a* of the individual electrode 35 is provided in the function area 60. As seen in the direction of thickness of the piezoelectric sheet 41, end portions of the outer peripheries 37*a* of the electrode portions 37 in the lengthwise direction of the pressure chamber area 40 are respectively located in areas between the function area 60 and the restricting areas 61. A substantial entirety of the pair of electrode portions 37 is located within the function area 60. A most part of the connection area 35*b* is also provided in the function area 60 and the extending portion 35*c* extends outside the function area 60.

In the above-mentioned arrangement of the individual electrode 35, the active portion K interposed between the main electrode area 35*a* of the individual electrode 35 and the common electrode 34 extends slightly out of the function area 60, but does not extend in the widthwise direction of the pressure chamber 10 to ranges of the pressure chamber area 40 which function to restrict the ink ejection or the deformation of the pressure chamber area 40, so that when an electric field is applied to the active portion K, the active portion K is deformed to just increase the volume of the pressure chamber 10. That is, since the piezoelectric unimorph is not located in the central portion of the pressure chamber area 40 but is located on either side of the central portion of the pressure chamber area 40, when the electric field is applied to the active portion K, the central portion of the pressure chamber area 40 is deformed into the convex shape upward so as to increase the volume of the pressure chamber 10 as a whole. This will be described later in detail.

Figure 7:
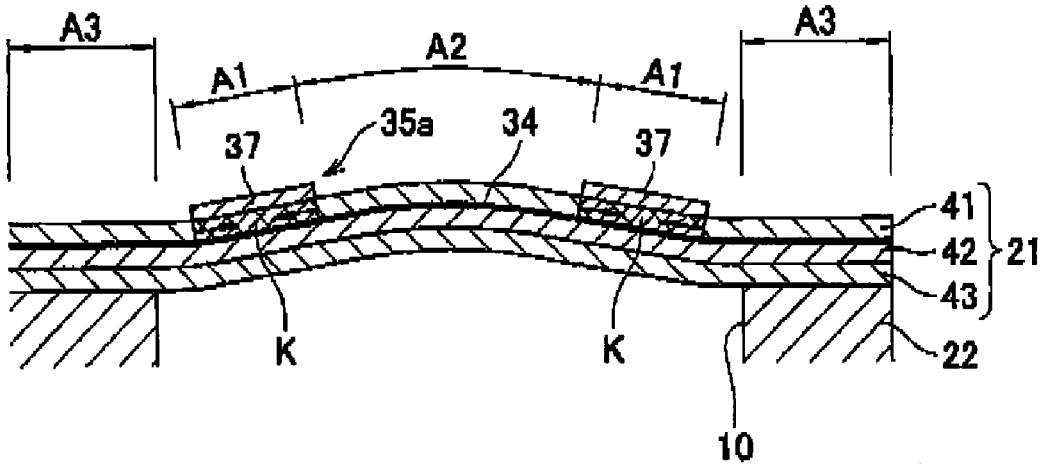
FIG. 7 is a cross-sectional view of a state of deformation of the actuator unit.

Next, there will be described an action of the actuator unit 21 when an ink ejection is performed. As shown in FIG. 7, when a drive voltage is selectively applied from the driver IC 52 to one of the plurality of the individual electrodes 35, an electric field in a vertical direction in FIG. 7 is applied to the piezoelectric sheet 41 interposed between the main electrode area 35*a* of the individual electrode 35 and the common electrode 34. Thus, the active portion K of the piezoelectric sheet 41 located right below the main electrode area 35*a* to which the drive voltage is applied extends in the direction of thickness of the piezoelectric sheet 41 as the polarization direction and contracts in the direction parallel to the plane of the piezoelectric sheet 41 and perpendicular to the polarization direction.

As mentioned above, the pair of electrode portions 37 of the main electrode area 35*a*, in their plan view, are not located in the central portion of the pressure chamber area 40 and are located on either side of the central portion of the pressure chamber area 40. Therefore, as shown in FIG. 7, areas of the actuator unit 21 which are aligned with portions located between the central portion of the pressure chamber 10 and the periphery thereof constitute driving areas A1 which are deformed when the electric voltage is applied to the individual electrode 35, and an area of the actuator unit 21 which is aligned with the central portion of the pressure chamber 10 constitutes a driven area A2 which is deformed to follow the deformation of the driving areas A1. Also, an area of the actuator unit 21 outside the pressure chamber 10 where the piezoelectric sheets 41 through 43 are bonded to the cavity plate 22 constitutes a restricted area A3 which is restricted to deform. While the piezoelectric sheet 41 located in the driving areas A1 contracts in the direction of plane of the piezoelectric sheet 41, the piezoelectric sheets 42, 43 located in the driving areas A1 do not deform, so that the driving areas A1 tend to deform into a convex shape toward the pressure chamber 10. However, since the restricted area A3 of the actuator unit 21 is fixed to the cavity plate 22, the driving areas A1 are deformed toward the direction opposite to the pressure chamber 10 and the driven area A2 is also deformed into a convex shape toward the direction opposite to the pressure chamber 10. The deformations of the driving areas A1 and the driven area A2 result in a deformation into a convex shape toward the direction opposite to the pressure chamber such that a center of the driven area A2 forms a top of the convex shape, leading to increasing the volume of the pressure chamber 10 and generating a negative pressure wave in the pressure chamber 10.

However, in a case in which the main electrode area 35*a* is aligned with the restricting areas 61 as seen in the direction of thickness of the piezoelectric sheet 41 and an active portion is provided in the restricting areas 61, when an electric field is applied to the active portion K located in the driving areas A1 and the active portion located in the restricted areas 61, an increase rate of volume of the pressure chamber 10 is lowered. The reason for this has not been found yet, but it has been obtained from results of an experiment made by the present inventor that the volume of the pressure chamber 10 can be increased at a high efficiency in a case in which the main electrode area 35 does not extend to the restricted areas 61.

When a time for the pressure wave generated by the increase in the volume of the pressure chamber 10 to propagate in one way in the lengthwise direction of the pressure chamber 10 has passed, the pressure in the pressure chamber 10 turns positive. At a timing when the pressure turns positive, the application of the drive voltage to the individual electrode 35 is stopped. Thus, the individual electrode 35 is returned to a ground potential and the piezoelectric sheets 41 through 43 are returned to their initial states and thus the volume of the pressure chamber 10 is decreased. At that time, the pressure wave generated by increasing the volume of the pressure chamber 10 and the pressure wave generated by returning the piezoelectric sheets 41 through 43 to their initial states are added to each other, and an intense pressure is applied to the ink accommodated in the pressure chamber 10 so as to eject the ink through the nozzle 8.

In the present inkjet head 1, only at timings when the ink is ejected, the drive voltage is applied to the individual electrode 35 and the electric field is applied to the active portion K of the piezoelectric sheet 41, so that a time period for which the drive voltage is applied to the piezoelectric sheet 41 can be shortened. Therefore, the piezoelectric sheet 41 is less deteriorated with respect to its ability of polarization and a timewise decrease in the amount of deformation of the piezoelectric sheets 41 through 43 can be restrained effectively. In addition, since the active portion K is not located in the restricted areas 61, when the electric field is applied to the active portion K, the deformation of the active portion K to increase the volume of the pressure chamber 10 is less restricted. Thus, a decrease in the pressure applied to the ink accommodated in the pressure chamber 10 is effectively restrained, leading to enjoying a high efficiency of the inkjet head 1.

In addition, the main electrode area 35*a* extends in the lengthwise direction of the pressure chamber 10 and the driven area A2 also extends in the lengthwise direction thereof. Therefore, a deformation point of the driven area A2 is spaced apart from fixed portions in the vicinity of the acute-angled end portions of the pressure chamber area 40 where the actuator unit 21 is fixed to the cavity plate 22, so that the actuator unit 21 can be preferably deformed over a wide range along the lengthwise direction of the pressure chamber 10. In other words, when the electric field is applied to the active portion K, an opposed area (the pressure chamber area 40) of the actuator unit 21 opposed to the pressure chamber 10 can be effectively deformed so as to increase the volume of the pressure chamber 10. Further, there are provided an inlet port and an outlet port respectively in the acute-angled end portions of the pressure chamber 10, so that the ink accommodated in the pressure chamber 10 can smoothly flow. Since the present embodiment can easily realize an arrangement of the inkjet head 1 with a high density, the inkjet head 1 can have a good ink ejection performance and enjoy a high resolution of recorded images.

Also, since the electrode portions 37 of the main electrode area 35*a* are provided symmetrically with respect to the imaginary line or the central portion of the pressure chamber area 40, the piezoelectric sheets 41 through 43 produce a balanced deformation in the opposed area opposed to the central portion of the pressure chamber 10 as the top of the deformation. Therefore, an efficiency of change in the volume of the pressure chamber 10 by the actuator unit 21 can be improved.

Further, the connection area 35*b* extends from one of the acute-angled end portions of the pressure chamber area 40 in the direction opposite to the other of the two acute-angled end portions and across the outline of the pressure chamber 10. However, a portion of the piezoelectric sheet 41 which is opposed to the vicinity of the one acute-angled end portion of the pressure chamber 10 does not affect the ink ejection and the change in the volume of the pressure chamber 10 when the electric field is applied to the piezoelectric sheet 41 interposed between the connection area 35*b* and the common electrode 34. Also, in the illustrated embodiment, the common electrode 34 is not provided in an area of the actuator unit 21 opposed to the electrode land 36, the extending portion 35*c*, and the connection area 35*b* and thus the electric field is not applied to the portion of the piezoelectric sheet 41 opposed to the connection area 35*b*. Thus, the portion of the piezoelectric sheet 41 opposed to the connection area 35*b* does not affect the change in the volume of the pressure chamber 10.

The present invention can be applied to a modified embodiment in which the pressure chamber 10 has, in its plan view, the shape of parallelogram and the modified embodiment can enjoy the same advantages as those of the first embodiment mentioned above.

Figure 8:
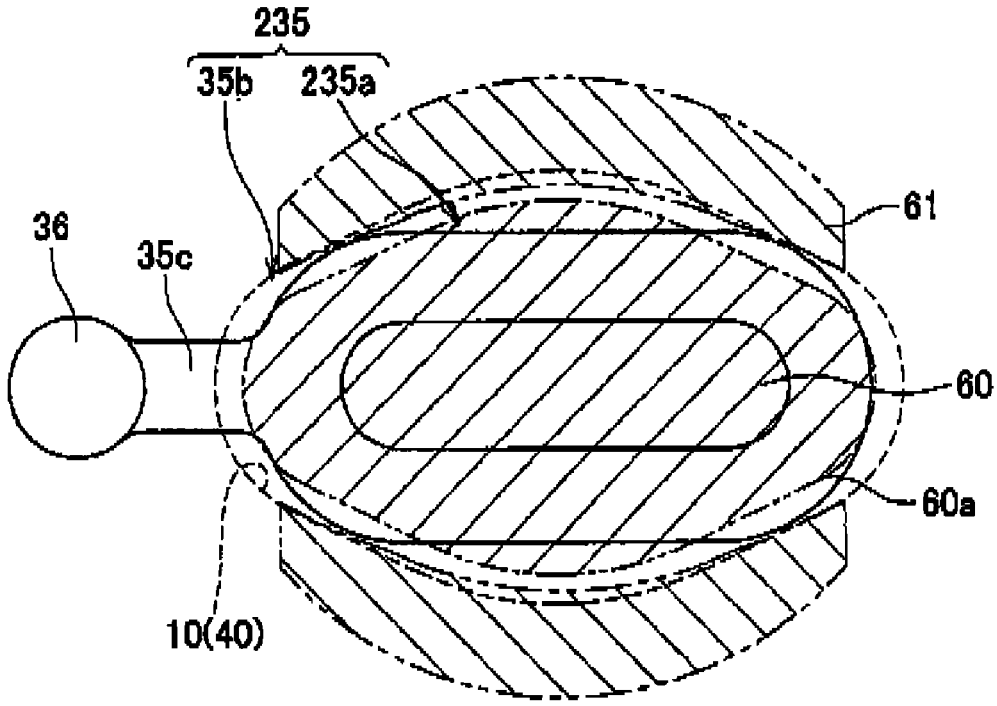
FIG. 8 is a plan view of an individual electrode of an inkjet head as a second embodiment of the present invention.

Next, there will be described an inkjet head as a second embodiment of the present invention. In this embodiment, only a plan-view shape of the individual electrode 235 is different from that of the individual electrode 35 in the first embodiment and components of the inkjet head except for the individual electrode 235 are the same as those in the first embodiment. Thus, the same reference numerals as used in the first embodiment are used to identify the corresponding components, and a detailed explanation thereof is not provided. In FIG. 8, outlines of the function area 60 and the restricting areas 61 are respectively illustrated in two-dot chain lines and the areas inside the outlines are hatched. Also, the pressure chamber 10 is indicated by a broken line.

As shown in FIG. 8, the individual electrode 235 in the present embodiment includes a connection area 35*b* described in the first embodiment and a belt-like main electrode area 235*a* which has an annular shape along an outline of the pressure chamber 10. The main electrode area 235*a*, as seen in the direction of thickness of the piezoelectric sheet 41, is not located in the central portion of the pressure chamber area 40 and is located on either side of the central portion thereof.

When a drive voltage is applied to the individual electrode 235, a portion of the piezoelectric sheet 41 interposed between the main electrode area 235*a* and the common electrode 34, that is, an active portion K contracts in a direction parallel to the plane of the piezoelectric sheet 41 and the piezoelectric sheets 42, 43 do not contract in the direction parallel to the plane of the piezoelectric sheet 41, similarly to the first embodiment, and thus the actuator unit 21 is deformed to increase the volume of the pressure chamber 10 such that a central portion of the opposed area (the pressure chamber area 40) of the piezoelectric sheet 41 opposed to the pressure chamber 10 forms a top or peak of the deformation. The main electrode area 235*a* is not located in the restricted areas 61, that is, no active portion K is provided in the restricted areas 61. When the electric field is applied to the active portion K, the deformation to increase the volume of the pressure chamber 10 is hardly restricted, similarly to the first embodiment. Therefore, a decrease in the pressure applied to the ink accommodated in the pressure chamber 10 is restrained, leading to enjoying a high efficiency of the inkjet head 1.

Similar to the first embodiment, at a timing when the pressure in the pressure chamber 10 turns positive, the application of the drive voltage to the individual electrode 235 is stopped. At the time, the pressure wave generated by increasing the volume of the pressure chamber 10 and the pressure wave generated by returning the piezoelectric sheets 41 through 43 to their initial states are added to each other and thus an intense pressure is applied to the ink accommodated in the pressure chamber 10 so as to eject the ink through the nozzle 8. In other words, similar to the first embodiment, only at timings when the ink is ejected, the drive voltage is applied to the individual electrode 235, so that a time period for which the drive voltage is applied to the piezoelectric sheet 41 can be shortened. Therefore, the piezoelectric sheet 41 is less deteriorated with respect to its ability of polarization and a timewise decrease in the amount of deformation of the piezoelectric sheets 41 through 43 can be restrained effectively.

Figure 9:
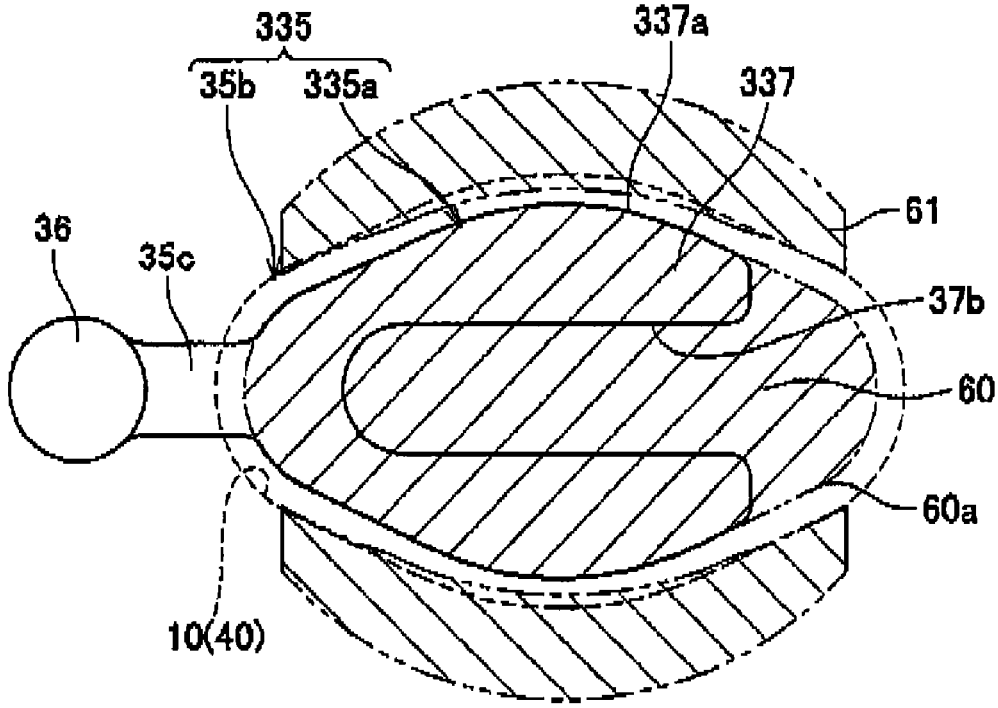
FIG. 9 is a plan view of an individual electrode of an inkjet head as a third embodiment of the present invention.

Further, there will be described an inkjet head as a third embodiment of the present invention. In this embodiment, only a plan-view shape of the individual electrode 335 is different from that of the individual electrode 35 in the first embodiment and components of the inkjet head except for the individual electrode 335 are the same as those in the first embodiment. Thus, the same reference numerals as used in the first embodiment are used to identify the corresponding components, and a detailed explanation thereof is not provided. In FIG. 9, outlines of the function area 60 and the restricting area 61 are respectively illustrated in two-dot chain lines and the areas inside the outlines thereof are hatched. Also, the pressure chamber 10 is indicated by a broken line.

In the present embodiment, as shown in FIG. 9, the individual electrode 335 includes a connection area 35*b* described in the first embodiment and a main electrode area 335*a* which extends in the lengthwise direction of the pressure chamber 10, and constitutes a substantially U-shaped belt-like electrode. The individual electrode 335, as seen in the direction of thickness of the piezoelectric sheet 41, extends along one of the two acute-angled end portions of the pressure chamber 10 and the two oblique sides thereof defining the one of the two acute-angled end portions. The individual electrode 335 is not located in the central portion of the pressure chamber 10 and is located on either side of the central portion of the pressure chamber 10.

The main electrode area 335*a* includes a pair of electrode portions 337 similar to the pair of the electrode portions 37 in the first embodiment. The pair of electrode portions 337, each of which is defined, as seen in the direction of thickness of the piezoelectric sheet 41, by an outer periphery 337*a* which extends along the outline of the pressure chamber 10 and on the base line 60*a* and an inner periphery 37*b* described in the first embodiment. The inner peripheries 37*b* of the pair of electrode portions 337 are distant from the imaginary line by a same distance. Also, the pair of electrode portions 337 are provided symmetrically with respect to the imaginary line as a centerline.

When the drive voltage is applied to the individual electrode 335, similarly to the first embodiment, since the piezoelectric sheet 41 contracts in the direction parallel to the plane of the piezoelectric sheet 41 and the piezoelectric sheets 42, 43 do not contract in the direction parallel to the plane of the piezoelectric sheets 42, 43, a portion interposed between the main electrode area 335*a* and the common electrode 34, that is, the active portion K is deformed such that the actuator unit 21 increases the volume of the pressure chamber 10 and a center of the opposed area (the pressure chamber area 40) of the piezoelectric sheet 41 opposed to the pressure chamber 10 forms a top of the deformation. The main electrode area 335*a* is aligned with only the function area 60 as seen in the direction of thickness of the piezoelectric sheet 41, so that the active portion K is provided within the function area 60. Therefore, when the electric field is applied to the active portion K, the actuator unit 21 is not restricted to deform or increase the volume of the pressure chamber 10. Further, the active portion K in the vicinity of the obtuse-angled portions of the pressure chamber 10 has a larger width in the widthwise direction of the pressure chamber 10 than that in the first embodiment, so that an amount of change in the volume of the pressure chamber 10 is greater than that in the first embodiment. In other words, the actuator unit 21 can be deformed to increase a greater volume of the pressure chamber 10 than in the first embodiment. Thus, the inkjet head enjoys an improved drive efficiency.

Similar to the first embodiment, at a timing when the pressure in the pressure chamber 10 turns positive, the application of the drive voltage to the individual electrode 335 is stopped. At the time, the pressure wave generated by increasing the volume of the pressure chamber 10 and the pressure wave generated by returning the piezoelectric sheets 41 through 43 to their initial states are added to each other and thus an intense pressure is applied to the ink accommodated in the pressure chamber 10 so as to eject the ink through the nozzle 8. In other words, similar to the first and the second embodiments, only at timings when the ink is ejected, the drive voltage is applied to the individual electrode 335, so that a time period for which the drive voltage is applied to the piezoelectric sheet 41 can be shortened. Therefore, the piezoelectric sheet 41 is less deteriorated with respect to its ability of polarization and a time-wise decrease in the amount of deformation of the piezoelectric sheets 41 through 43 can be restrained effectively.

There will be described an inkjet head as a fourth embodiment of the present invention. In this embodiment, a passage unit 404 and an actuator unit 421 are slightly different from the passage unit 4 and the actuator unit 21 in the first embodiment and the other components of the inkjet head are the same as those in the first embodiment. Thus, the same reference numerals as used in the first embodiment are used to identify the corresponding components, and a detailed explanation thereof is not provided.

Figure 10A:
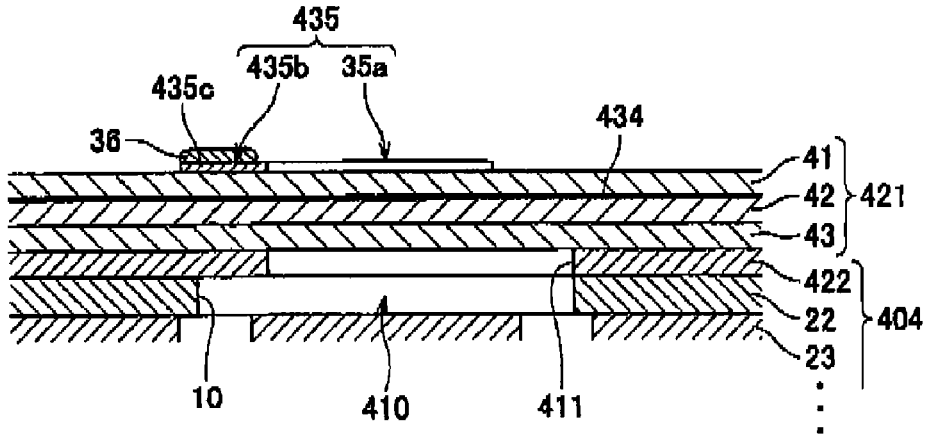
FIG. 10A is a cross-sectional view of an actuator unit of an inkjet head as a fourth embodiment of the present invention.
Figure 10B:
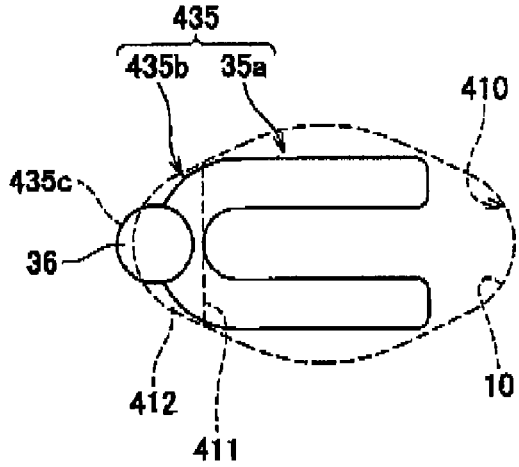
FIG. 10B is a plan view of an individual electrode of the actuator unit of FIG. 10A.

As shown in FIGS. 10A and 10B, the passage unit 404 in the present embodiment includes a cavity plate 422 which is provided on an upper surface of the passage unit 4 described in the first embodiment and which is formed of the same material as that of the cavity plate 22. The cavity plate 422 has a plurality of holes 411 which are opposed to the holes defining the pressure chambers 10 of the cavity plate 22. As shown in FIG. 10B, each of the holes 411 has a plan-view shape corresponding to an opposed area of the cavity plate 422 that is opposed to the pressure chamber 10 except for a vicinity of one of the two acute-angled end portions of the pressure chamber 10 (the left-hand-side acute-angled end portion in FIG. 10B).

Since the two cavity plates 22, 422 are staked on each other, the passage unit 404 includes (1) an overhang area 412 which projects into the one of the two acute-angled end portions of the pressure chamber 10 so as to cover the one of the two acute-angled end portions thereof as seen in the direction of thickness of the piezoelectric sheet 41 and (2) a pressure chamber 410 which is defined by the hole defining the pressure chamber 10 and the hole 411 that communicates with the former hole. The overhang area 412 extends inward over the outline of the pressure chamber 410 from the one of the two acute-angled end portions thereof as seen in the direction of thickness of the piezoelectric sheet 41. The outline (outermost contour line) of the pressure chamber 410 coincides with the outline of the pressure chamber 10, but an opening of the pressure chamber 410 on the upper surface of the passage unit 404 is smaller than that of the pressure chamber 10. That is, the pressure chamber 410 is substantially the same as the pressure chamber 10 and only the plan-view shape of the opening of the pressure chamber 410 is different from that of the pressure chamber 10. The other components of the passage unit 404 are the same as those of the passage unit 4 in the first embodiment.

In the actuator unit 421 in the present embodiment, respective plan-view shapes of the individual electrode 435 and the common electrode 434 are different from those in the first embodiment and the other components of the actuator unit 421 are the same as those in the first embodiment. The common electrode 434 is provided over an entirety of respective opposed surfaces of the piezoelectric sheets 41, 42. In other words, the common electrode 434 is also provided in an area which is opposed to a connection area 435*b*, described below. The individual electrode 435 includes the main electrode area 35*a* in the first embodiment and the connection area 435*b* which is aligned with the overhang area 412, in its plan view, and is connected to the main electrode area 35*a*. The individual electrode 435 is a belt-like U-shaped electrode which is not located in a central portion of the pressure chamber 410 and is located on either side of the central portion thereof.

As shown in FIG. 10B, the connection area 435*b* includes an extending portion 435*c* which extends shorter than the extending portion 35*c* described in the first embodiment. The extending portion 435*c* extends from the one of the two acute-angled portions of the pressure chamber 410 in a direction opposite to the other of the two acute-angled portions thereof and across the outline of the pressure chamber 410. Also, an electrode land 36 is provided in the connection area 435*b* such that more than a half of the area of the land 36 overlaps the extending portion 435*c* as seen in the direction of thickness of the piezoelectric sheet 41. Further, a center of the connection area 435*b* is, in its plan view, aligned with the overhang area 412 and a center of the electrode land 36 is also aligned with the overhang area 412. Prom another point of view, the connection area 35*b* does not include the extending portion 435*c* and the electrode land 36 is provided in the connection area 435*b* such that an area of the electrode land 36 extends outward across the outline of the pressure chamber 410 as seen in the direction of thickness of the piezoelectric sheet 41.

When the drive voltage is applied to the individual electrode 435, the actuator unit 421 performs in the same way as described in each of the first, second and third embodiments. More specifically, the piezoelectric sheets 41 through 43 are deformed to increase a volume of the pressure chamber 410 such that a center of an opposed area of the piezoelectric sheets 41 through 43 which is opposed to the opening of the pressure chamber 410 forms a top or peak of the deformation. Similar to the first embodiment, at a timing when the pressure in the pressure chamber 410 turns positive, the application of the drive voltage to the individual electrode 435 is stopped. At the time, an intense pressure is applied to the ink accommodated in the pressure chamber 410 so as to eject the ink through the nozzle 8. Therefore, the inkjet head in the present embodiment can enjoy the same advantages as those described in the first through third embodiments.

The extending portion 435*c* of the connection area 435*b*, in its plan view, extends slightly out of the pressure chamber 410 and a substantial entirety of the connection area 435*b* is located within the opposed area of the piezoelectric sheet 41 opposed to the pressure chamber 410, leading to an arrangement of the plurality of pressure chambers 410 at a high density. Though the connection area 435*b* extends outward across the outline of the pressure chamber 410, an area of the piezoelectric sheet 41 that is opposed to the one of the two acute-angled end portions of the pressure chamber 410 is an area which does not contribute to an ink ejection and the connection area 435*b* is located in that area. Thus, when the electric field is applied to a portion of the piezoelectric sheet 41 between the connection area 435*b* and the common electrode 434, a change in the volume of the pressure chamber 410 is not influenced by that portion. In this structure, crosstalks do not occur to another pressure chamber 410 adjacent to the pressure chamber 410 corresponding to the connection area 435*b*.

Furthermore, the center of the connection area 435*b* and the center of the electrode land 36 are respectively aligned with the overhang area 412, so that the actuator unit 421 is prevented from being damaged by an external force given thereto when the connection area 435*b* is connected to the wire of the FPC 50. The same components as those employed in the first embodiment can enjoy the same advantages as those described in the first embodiment. Owing to the overhang area 412 extending inward over the outline of the pressure chamber 410, the ink can more smoothly flow in the pressure chamber 410 and bubbles and foreign matters are prevented from remaining in the pressure chamber 410.

In the present embodiment, the cavity plate 422 is stacked on the upper surface of the passage unit 4 described in the first embodiment, for providing the overhang area 412 extending inward over the outline of the pressure chamber 410. However, the overhang area 412 may be formed in a different way. For example, when the hole defining the pressure chamber 10 is formed in the cavity plate 22, respective etching times needed to etch opposite surfaces (an upper and a lower surfaces) of the cavity plate 22 are arranged properly, so that an overhang area similar to the overhang area 412 can be formed in the hole defining the pressure chamber 10 of the cavity plate 22.

While an etching operation is performed to form the hole 411 from the upper surface of one cavity plate 22 with a portion of the upper surface thereof except for a portion thereof corresponding to the hole 411 covered with a masking member, another etching operation is performed to form another hole defining the pressure chamber 10 from the lower surface thereof with a portion of the lower surface thereof except for a portion thereof corresponding to the pressure chamber 10 covered with another masking member. Those etching operations are finished when the hole 411 and the latter hole communicate with each other. In a case, for example, in which the etching time to etch the hole 411 is made shorter than that to etch the hole defining the pressure chamber 10, an thickness of the overhang area is made smaller than a half of that of the cavity plate 22. On the other hand, in a case in which the etching time to etch the hole 411 is made longer than that to etch the hole defining the pressure chamber 10, the thickness of the overhang area is made larger than a half of that of the cavity plate 22.

There next will be described an inkjet head as a fifth embodiment of the present invention. In this embodiment, a plan-view shape of an individual electrode 535 is slightly different from that of the individual electrode 435 employed in the fourth embodiment and the other components of the inkjet head are the same as those described in the fourth embodiment. Therefore, the same reference numerals as used in the fourth embodiment are used to identify the corresponding components, and a detailed explanation thereof is not provided.

Figure 11A:
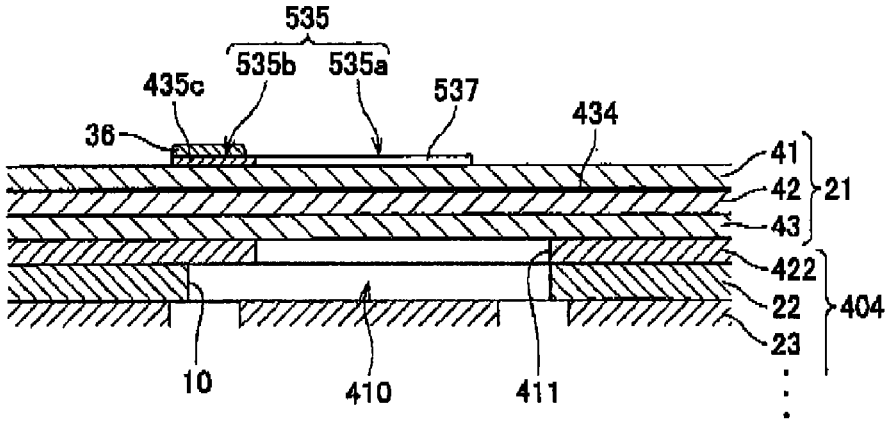
FIG. 11A is a cross-sectional view of an actuator unit of an inkjet head as a fifth embodiment of the present invention.
Figure 11B:
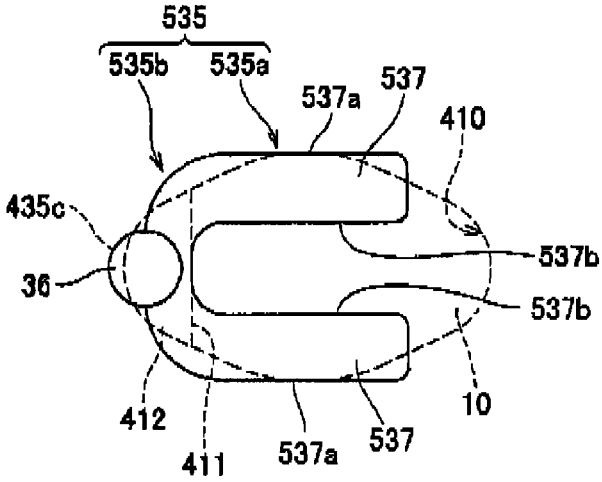
FIG. 11B is a plan view of an individual electrode of the actuator unit of FIG. 11A.

As shown in FIGS. 11A and 11B, the individual electrode 535 in the present embodiment includes a main electrode area 535*a* which extends in a lengthwise direction of the pressure chamber 410, and a connection area 535*b* which is aligned with the overhang area 412 and is connected to the main electrode area 535*a*. The individual electrode 535 is a belt-like U-shaped electrode which is not located on the central portion of the pressure chamber 410 and is located on either side of the central portion thereof.

As shown in FIG. 11B, the main electrode area 535*a* includes a pair of electrode portions 537 which extend in the lengthwise direction of the pressure chamber 410, on either side of the central portion of the pressure chamber 410. Each of the pair of electrode portions 537 includes an outer periphery 537*a* and an inner periphery 537*b* which extend in the lengthwise direction of the pressure chamber 410. Each electrode portion 537 has a larger width in a widthwise direction (a vertical direction in FIG. 11B) perpendicular to the lengthwise direction of the pressure chamber 410 than that of the electrode portion 37 described in the first embodiment, and the outer periphery 537*a* is partly aligned with the corresponding obtuse-angled portion of the pressure chamber 410 as seen in the direction of thickness of the piezoelectric sheet 41. Also, similar to the first embodiment, the inner peripheries 537*b* of the pair of electrode portions 537 are distant from the imaginary line by a same distance. Further, the two electrode portions 537 are symmetrically provided with respect to the imaginary line as a centerline. The connection area 535*b* is enlarged corresponding to an enlargement of the main electrode area 535*a*, but a structure of the connection area 535*b* is the same as that of the connection area 435*b* described in the fourth embodiment.

When the drive voltage is applied to the individual electrode 535, the actuator unit 421 performs in the same way as described in the fourth embodiment. Accordingly, only at timings when the ink is ejected, the drive voltage is applied to the individual electrode 535, so that a time period for which the drive voltage is applied to the piezoelectric sheet 41 can be shortened. Therefore, the piezoelectric sheet 41 is less deteriorated with respect to its ability of polarization and a timewise decrease in the amount of deformation of the piezoelectric sheets 41 through 43 can be restrained effectively. The remaining components of the inkjet head in the present embodiment which have the same structures as those in the first and fourth embodiments can enjoy the same advantages as those described in the first and fourth embodiments.

It is to be understood that the present invention may be embodied with various changes and improvements that may occur to a person skilled in the art, without departing from the spirit and scope of the invention defined in the appended claims. For example, though, in the illustrated embodiments, the pressure chamber 10, 410 has a parallelogramic shape or a rhombic shape with rounded corners which has two acute-angled end portions in opposite end portions in a lengthwise direction of the pressure chamber, the pressure chamber may have a different shape such as a triangular, quadrangular or oval shape. Also, in each of the first through third embodiments, the common electrode 34 may also be located in an area which is opposed to the connection area 35*b*. Further, the individual electrode 35, 235, 335, 435, 535 may not have the connection area 35*b*, 435*b*, 535*b* which is connected to the main electrode area. In this case, wires of the FPC 50 can be electrically connected to the respective electrode portions of the main electrode area which are located on either side of the central portion of the pressure chamber in their plan view.

What is claimed is:

1. An inkjet head, comprising:

a passage unit having a pressure chamber which is in communication with a nozzle and which is defined by a recessed portion provided in one surface of the passage unit; and an actuator unit including:

(a) an oscillating plate fixed to the one surface of the passage unit so as to close the recessed portion defining the pressure chamber;

(b) a piezoelectric layer disposed on the oscillating plate so that the piezoelectric layer and the oscillating plate cooperate with each other to constitute a piezoelectric unimorph;

(c) a first electrode provided on a side of one surface of the piezoelectric layer so as to correspond to the pressure chamber; and (d) a second electrode provided on a side of an other surface of the piezoelectric layer and opposed to the first electrode in a direction of thickness of the piezoelectric layer, wherein the pressure chamber has an elongate shape, wherein the piezoelectric layer includes an active portion that is interposed between the first electrode and the second electrode and, as seen in the direction of thickness of the piezoelectric layer, is not located in a central portion of an opposed area thereof opposed to the pressure chamber and is located on either side of said central portion of the opposed area in a widthwise direction perpendicular to a lengthwise direction of the pressure chamber, the opposed area of the piezoelectric layer being deformed to increase a volume of the pressure chamber when an electric field is applied to the active portion, wherein the first electrode includes a pair of electrode portions which extend along respective two sides of an opening of the elongate pressure chamber that extend in the lengthwise direction and are opposed to each other, a substantial entirety of the pair of electrode portions being located within an area defined by the two sides of the opening of the pressure chamber, as seen in the direction of thickness of the piezoelectric layer, and wherein a clearance is provided, on at least a middle portion of the pressure chamber in the lengthwise direction thereof, between a periphery of the opening of the pressure chamber and an outer periphery of each electrode portion, as seen in the direction of thickness of the piezoelectric layer.

2. The inkjet head according to claim 1, wherein the active portion, as seen in the direction of thickness of the piezoelectric layer, does not extend, in the widthwise direction of the pressure chamber, to a range of the opposed area of the piezoelectric layer, the range restricting the deformation of the opposed area to increase the volume of the pressure chamber when the electric field is applied to the active portion.

3. The inkjet head according to claim 1, wherein a plurality of said pressure chambers are provided in the one surface of the passage unit, wherein each of the oscillating plate and the piezoelectric layer consists of at least one sheet which is common to the plurality of pressure chambers and which has a uniform thickness over an entirety thereof, and wherein the first electrode is not provided on the central portion of the opposed area of the piezoelectric layer that corresponds to a central portion of each of the plurality of pressure chambers, and is provided on respective portions of the opposed area that extend along two sides of said each pressure chamber that extend in the lengthwise direction thereof and are opposed to each other.

4. The inkjet head according to claim 1, wherein the pressure chamber has a substantially parallelogram shape, as seen in the direction of thickness of the piezoelectric layer, which has two acute-angled end portions in the lengthwise direction of the pressure chamber and two obtuse-angled portions in a middle portion thereof in the lengthwise direction thereof, and wherein the first electrode extends in the lengthwise direction of the pressure chamber.

5. The inkjet head according to claim 4, wherein the first electrode includes a pair of electrode portions which extend along respective two sides of an opening of the elongate pressure chamber that extend in the lengthwise direction thereof and are opposed to each other, a substantial entirety of the pair of electrode portions being located within an area defined by the two sides of the opening of the pressure chamber, as seen in the direction of thickness of the piezoelectric layer, and wherein a clearance is provided between a periphery of the opening of the pressure chamber at each of the obtuse-angled portions thereof and an outer periphery of a corresponding one of the two electrode portions, as seen in the direction of thickness of the piezoelectric layer.

6. The inkjet head according to claim 4, wherein the pressure chamber has the substantially parallelogram shape with rounded corners.

7. The inkjet head according to claim 4, wherein the first electrode, as seen in the direction of thickness of the piezoelectric layer, has a U-shape extending along one of the two acute-angled end portions of the parallelogram shape and two oblique sides thereof defining said one of the two acute-angled end portions.

8. The inkjet head according to claim 4, wherein the first electrode, as seen in the direction of thickness of the piezoelectric layer, has an annular shape along an outline of the pressure chamber.

9. The inkjet head according to claim 4, wherein the first electrode includes a main electrode area which is opposed to the opening of the pressure chamber, and a connection area which is connected to an electric wire for transmitting a drive signal to drive the actuator unit, and wherein the connection area, as seen in the direction of thickness of the piezoelectric layer, extends from one of the acute-angled end portions in a direction opposite to an other of the two acute-angled end portions and across the outline of the pressure chamber.

10. The inkjet head according to claim 9, wherein the second electrode is opposed to an entirety of the main electrode area and is not opposed to the connection area in the direction of thickness of the piezoelectric layer.

11. The inkjet head according to claim 4, wherein the first electrode includes a pair of electrode portions, each of which is defined, as seen in the direction of thickness of the piezoelectric layer, by an outer periphery which extends substantially parallel to the outline of the pressure chamber and an inner periphery which extends parallel to an imaginary line connecting between the two acute-angled end portions and is distant from the imaginary line by a same distance.

12. The inkjet head according to claim 4, wherein the pressure chamber includes at least one overhang area which is provided in at least one of the two acute-angled end portions such that the one surface of the passage unit extends inward over the outline of the pressure chamber as seen in the direction of thickness of the piezoelectric layer, wherein the first electrode includes a main electrode area which is opposed to the opening of the pressure chamber and a connection area which is connected to an electric wire for transmitting a drive signal to drive the actuator unit, and wherein a center of the connection area is aligned with the overhang area as seen in the direction of thickness of the piezoelectric layer.

13. An inkjet head, comprising:

a passage unit having a pressure chamber which is in communication with a nozzle and which is defined by a recessed portion provided in one surface of the passage unit; and an actuator unit including:

(a) an oscillating plate fixed to the one surface of the passage unit so as to close the recessed portion defining the pressure chamber;

(b) a piezoelectric layer disposed on the oscillating plate so that the piezoelectric layer and the oscillating plate cooperate with each other to constitute a piezoelectric unimorph;

(c) a first electrode provided on a side one surface of the piezoelectric layer so as to correspond to the pressure chamber; and (d) a second electrode provided on a side of an other surface of the piezoelectric layer and opposed to the first electrode in a direction of a thickness of the piezoelectric layer, wherein the first electrode includes, as seen in the direction of thickness of the piezoelectric layer, (1) a main electrode area which is opposed to the pressure chamber, is not aligned with a central portion of the pressure chamber, and extends along an outline of the pressure chamber and (2) a connection area which is connected to an electric wire for transmitting a drive signal to drive the actuator unit, wherein a center of the connection area is aligned with the pressure chamber as seen in the direction of thickness of the piezoelectric layer, wherein a volume of the pressure chamber is increased when an electric field is applied to an active portion of the piezoelectric layer that is interposed between the first electrode and the second electrode, and wherein the pressure chamber has, as seen in the direction of thickness of the piezoelectric layer, an elongate and substantially parallelogram shape which has two acute-angled end portions in a lengthwise direction thereof, and wherein the main electrode area extends in the lengthwise direction of the pressure chamber.

14. The inkjet head according to claim 13, wherein the pressure chamber includes at least one overhang area which is provided in at least one of the two acute-angled end portions such that the one surface of the passage unit extends inward over the outline of the pressure chamber as seen in the direction of thickness of the piezoelectric layer, and wherein a center of the connection area is aligned with the overhang area as seen in the direction of thickness of the piezoelectric layer.

15. An inkjet head, comprising:

a passage unit having a pressure chamber which is in communication with a nozzle and which is defined by a recessed portion provided in one surface of the passage unit; and an actuator unit including:

(a) an oscillating plate fixed to the one surface of the passage unit so as to close the recessed portion defining the pressure chamber;

(b) a piezoelectric layer disposed on the oscillating plate so that the piezoelectric layer and the oscillating plate cooperate with each other to constitute a piezoelectric unimorph;

(c) a first electrode provided on a side of one surface of the piezoelectric layer so as to correspond to the pressure chamber; and (d) a second electrode provided on a side of an other surface of the piezoelectric layer and opposed to the first electrode in a direction of thickness of the piezoelectric layer, wherein the pressure chamber has an elongate shape, wherein the piezoelectric layer includes an active portion that is interposed between the first electrode and the second electrode and, as seen in the direction of thickness of the piezoelectric layer, is not located in a central portion of an opposed area thereof opposed to the pressure chamber and is located on either side of said central portion of the opposed area in a widthwise direction perpendicular to a lengthwise direction of the pressure chamber, the opposed area of the piezoelectric layer being deformed to increase a volume of the pressure chamber when an electric field is applied to the active portion, wherein the pressure chamber has a substantially parallelogram shape, as seen in the direction of thickness of the piezoelectric layer, which has two acute-angled end portions in the lengthwise direction of the pressure chamber and two obtuse-angled portions in a middle portion thereof in the lengthwise direction thereof, and wherein the first electrode extends in the lengthwise direction of the pressure chamber.

* * * * *